United States Patent [19]

Healy

[11] Patent Number: 5,069,103

[45] Date of Patent: Dec. 3, 1991

[54] STRINGED INSTRUMENT SUPPORT DEVICE

[76] Inventor: Brian C. Healy, 2212 Carol View Dr., #C301, Cardiff by the Sea, Calif. 92007

[21] Appl. No.: 580,170

[22] Filed: Sep. 10, 1990

[51] Int. Cl.[5] ..... G10D 3/00; G10G 5/00

[52] U.S. Cl. ..... 84/327; 224/910

[58] Field of Search ..... 84/327, 280, 385 A, 84/ 387, 421, 453; 224/910

[56] References Cited

U.S. PATENT DOCUMENTS

| | | | |
|---|---|---|---|
| 2,510,799 | 6/1950 | Carley | 84/327 |
| 2,717,437 | 9/1955 | DeMestral | 24/445 X |
| 3,114,951 | 12/1963 | De Mestral | 24/449 |
| 3,323,698 | 6/1967 | Sottile | 224/910 X |
| 3,833,751 | 3/1974 | Chapman | 84/327 |
| 3,894,464 | 7/1975 | Brooks | 84/327 |
| 4,014,240 | 3/1977 | Pullen | 84/327 |
| 4,084,477 | 4/1978 | Dominguez | 84/327 |
| 4,171,555 | 10/1979 | Bakker et al. | 24/200 |
| 4,188,851 | 2/1980 | Wolf | 84/327 |
| 4,251,016 | 2/1981 | O'Rafferty et al. | 224/920 X |
| 4,254,901 | 3/1981 | McIntosh | 224/910 X |
| 4,656,917 | 4/1987 | VanHalen | 84/327 |
| 4,785,705 | 11/1988 | Patterson | 84/327 X |
| 4,858,801 | 8/1989 | Sameniego | 224/910 X |
| 5,000,071 | 3/1991 | Thomas | 84/327 |

*Primary Examiner*—Brian W. Brown

*Attorney, Agent, or Firm*—John J. Murphey

[57] ABSTRACT

A device for removeably supporting a stringed instrument in playing position, of the type comprising a large sound box with strings mounted thereover that extend along a narrow neck, comprising a wide, waist-encircling belt defined by spaced-apart upper and lower edges, terminated by spaced-apart ends and including inter-connecting Velcro pads for attaching the belt about one's waist in overlap fashion, a first short length of flexible strap attached to one end to the belt, a second short length of flexible strap attached at one end to the instrument, spaced-apart from the neck, inter-connectable buckle halves for temporarily inter-connecting the first and the second straps to provide support for a portion of the weight of the instrument while providing room to lift the instrument away from the belt, and a shaped bracket including a shank portion including screws for mounting on the back surface of the sound box spaced-apart from the point of attachment of the second strap, a wide, downwardly angling hook portion, forming a top edge that is fixed to an acute angle with the neck of the instrument, for hooking over the belt to temporarily support the balance of the weight of the stringed instrument and retain it in playing position, and a transition portion inter-connecting the shank portion and the hook portion, curving away from the base portion to enable the hook portion to retain the stringed instrument close against the performer's body.

19 Claims, 3 Drawing Sheets

STRINGED INSTRUMENT SUPPORT DEVICE

BACKGROUND OF THE INVENTION

1. Field Of The Invention

This invention pertains to the field of stringed musical instruments. More particularly, it pertains to stringed instruments of the type held in front of the performer while it is being played, while the strings are plucked. More specifically, the invention is a device for removably supporting the instrument in the playing position.

2. Description of the Prior Art

Stringed instruments such as banjos, ukuleles, mandolins, guitars and the like are often played while the performer is standing and holding the instrument in front of their body. For most of these instruments, just positioning and holding the instrument in front of the body during performance is sufficient throughout the entire performance. Guitars, however, are somewhat singular in that the performer, during performance, often wishes to maneuver the instrument into positions other than the conventional front-of-the-body position.

Particularly in the field of rock music guitar players, it is quite common for guitarists to swing the guitar wildly about themselves, above their heads, and down near the floor or other supporting surface during the performance. With performances lasting up to several hours, holding the guitar in a playable position is extremely tiring and can cause sufficient fatigue in the performers arms and hands as to reduce the performers artistic abilities and speed. With no support for the guitar following these wild maneuvers, it becomes even more of a strain on the performer.

The prior art has attempted to provide support devices for relieving the arm strain from the performer by supporting the guitar and other stringed instruments through the use of straps, levers, belts, etc. U.S. Pat. Nos. 2,510,799; 3,323,698; 3,894,464; 4,014,240; 4,188,851; 4,251,016; 4,254,901; 4,656,917; and 4,785,705 are examples of prior art attempts to provide such support of the stringed instrument for the performer. Most of these prior art devices utilize straps that are passed over the shoulders, around the neck, or otherwise across the torso and terminate in clasps that may be attached to the stringed instrument to support it in front of the performer. However, they all share one common disadvantage. Little thought has been given to providing the performer with the ability to carry on the wild gyrations of his/her body and of the stringed instruments, as is expected and common during personal performances, to allow the stringed instrument to be re-set or re-supported in the playing position, at the front of the performer's body, following cessation of these gyrations. Such an ability would allow the performer to continue playing the music without the stress and strain of continually supporting the instrument, or from interrupting their performance to reattach the guitar or other stringed instrument to the support structure.

Accordingly, there is still a need in the industry for a removable support system, for a stringed instrument, such as to allow the user or performer to remove the instrument from the support system in one swift motion, undergo the gyrations and other movements with the guitar that is a part of the performer's presentation or act, and thereafter, in one swift movement, replace the stringed instrument on the support system for further playing without unduly straining the performer or interrupting his or her performance.

SUMMARY OF THE INVENTION

This invention comprises a wide, waist-encircling belt, worn by a performer, that contains a short strap, to be attached to another short strap which is attached to the butt end, or lower end, of the stringed instrument, to support a portion of the weight of the instrument and yet provide room to lift the instrument away from the belt. A shaped bracket is attached to the back of the stringed instrument and contains a downwardly angling hook-portion that forms across the top thereof, an acute angle, with the narrow neck of the stringed instrument. It is adapted for hooking over the waist-encircling belt, is designed to have an outwardly and downwardly extending lip portion, and is further curved away from the musical instrument to allow the top end, or neck end, of the instrument to be quickly removed from the belt, in one swift motion, for gyrating and moving the stringed instrument about the performer's body; and thereafter, in one swift movement, replace the hook over the waist-encircling belt so that the combination of the short strap, attached between the belt and the butt end of the stringed instrument, and the hook portion of the bracket support all of the weight of the guitar or other stringed instrument, thereby relieving the support burden from the arms and shoulder of the performer.

Accordingly, the main object of this invention is a device for removably supporting a stringed instrument in the playing position at the front or side of the performer's body, that is releasable therefrom in one swift, upward motion and replaced in one swift, downward motion without causing interruption during the detachment and reattachment phase of the performance. Other objects of the invention include a lightweight support for a stringed instrument that is attached to the rear of the instrument so as to be unobtrusive and out of sight and thereby not detracting from either the performer's outfit or performance; a device that is easily attached to a wide variety of stringed instruments; a device that utilizes a waist-encircling belt that may be used by a variety of sizes and shapes of individuals without detracting from the efficacy of the support function of the device; a device that takes into account the curvature of the performer's body and compensates for this curvature by retaining the stringed instrument in a supportive configuration adjacent to the performer's body; a device that is able to be adjusted for various sizes and shapes of stringed instruments as well as various sizes and shapes of performers; and a device that is constructed of inexpensive and non-environmentally-threatening material. These and other objects of the invention will become more apparent upon reading the description of the preferred embodiment taken in conjunction with the drawings attached hereto. The scope of protection sought by the inventor may be gleaned from a fair reading of the claims that conclude this specification.

DESCRIPTION OF THE PREFERRED EMBODIMENT

Figure 1:
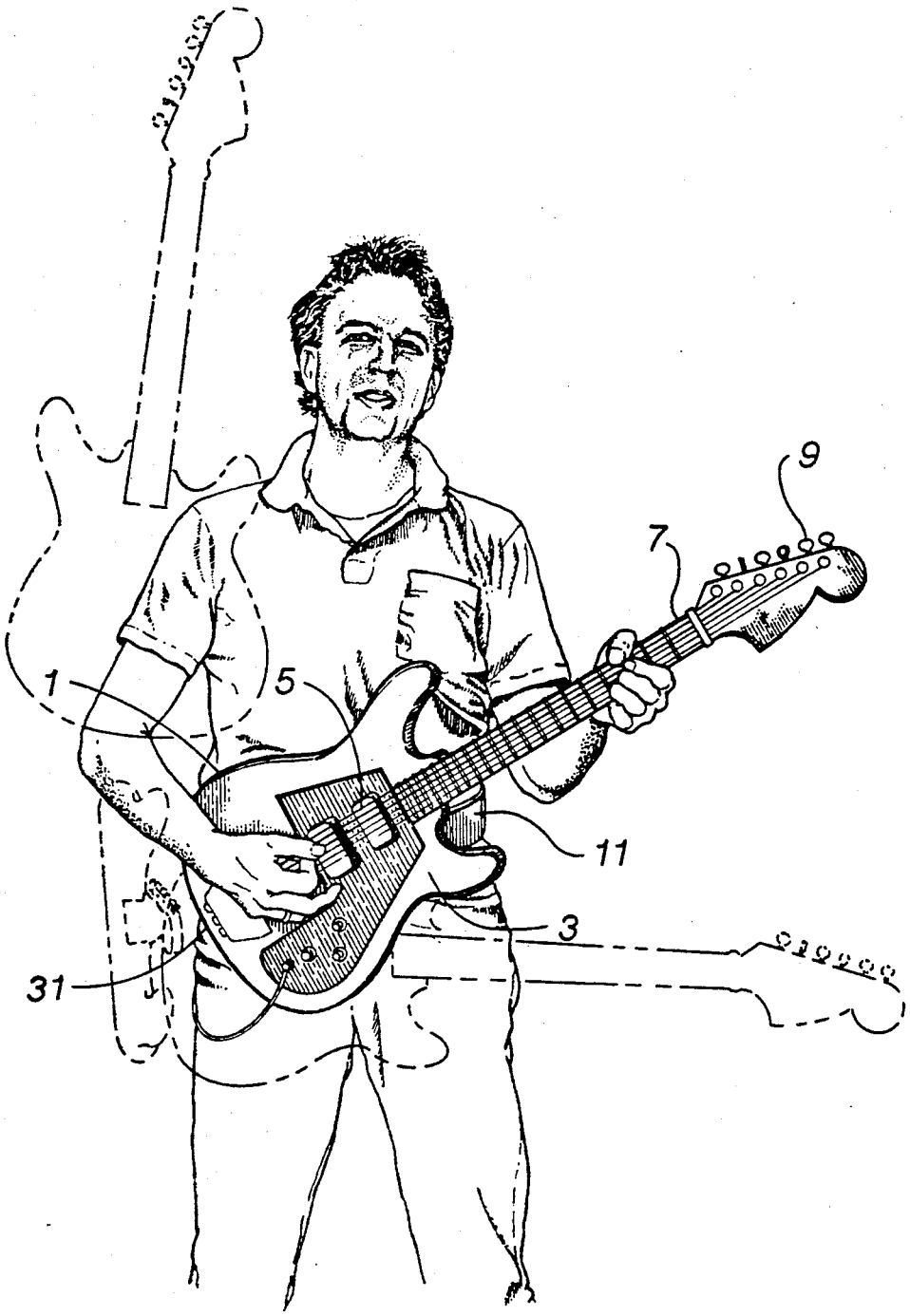
FIG. 1 is an illustrative view of an individual holding a generic-type stringed instrument in playing position with other positions that the performer may move the instrument shown in phantom outline.

As shown in the figures where like elements are identified with like numbers throughout the 8 figures, shown in FIG. 1 is a generic type of stringed instrument 1 that comprises a large sound box 3 with a plurality of strings 5 mounted there over and extending outward from box 3 along a narrow neck 7 to terminate at a plurality of tuning pegs 9. This instrument is normally held in front of the performer, across his or her chest at an angle such that, as shown, one of the performer's hands presses on the strings along the neck to achieve different vibration lengths and the fingers of the other hand may be used to pluck the strings to obtain the desired sound. Stringed instruments such as banjos, ukeleles, mandolins, fiddles and guitars are considered to be within the generic term of "stringed" instrument.

Figure 2:
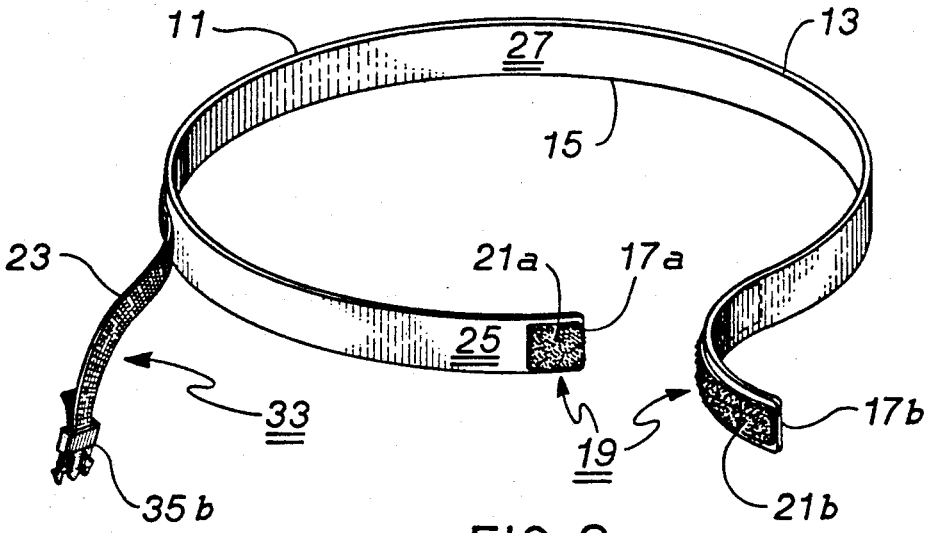
FIG. 2 is an illustration of the front elevational view of the wide, waist-encircling belt of this invention.
Figure 8:
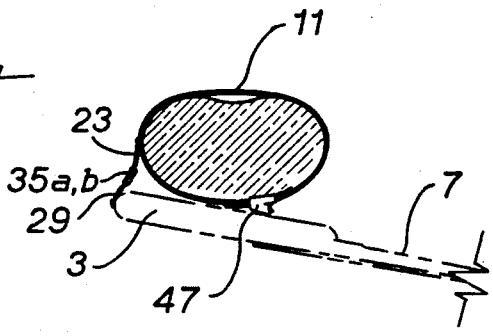

The device of this invention includes a wide, waist-encircling belt 11 that is shown in FIG. 2 defined by upper and lower belt edges 13 and 15 respectively, and terminated by a pair of spaced-apart ends 17*a* and 17*b*. Means 19 are included for attaching belt 11 about one's waist in overlapping fashion as shown in FIG. 8.

Means 19 may include a wide variety of commonly recognized inter-attachment devices including buckles, magnets, clips and other such devices. Specifically preferred, in this invention, is a pad 21*a* of hook elements and a longer pad 21*b* of loop elements that are attached to the outside front and inside front respectively of belt 11 and midway between upper and lower belt edges 13 and 15. Hook elements 21*a* and loop elements 21*b* are resilient and deformable and when pressed together become removably entangled, thereby securing the ends of belt 11 together. They can be released from entangled engagement by positively pulling hook element 21*a* away from loop elements 21*b* or vice versa. The hook and loop fabric elements 21*a* and 21*b* are available under the trademark, "Velcro"; more specific details of which may be obtained from U.S Pat. No. 2,717,437 entitled VELVET TYPE FABRIC AND METHOD OF PRODUCING SAME issued Sept. 13, 1955 to George de Mestral and U.S. Pat. No. 3,114,951 entitled DEVICE FOR JOINING TWO FLEXIBLE ELEMENTS issued Dec. 24, 1963 to George de Mestral. The material is hereinafter referred to as "VELCRO" loop material "VELCRO" hook material, a product of American Velcro, Inc. Pad 21*b* is made longer than pad 21*a* to allow belt 11 to fit a wide range of waist sizes that commonly occur with performers of different ages and sex. As shown in FIG. 2, a short length of flexible strap 23 is attached by sewing, riveting gluing or other known means, to the outside surface 25 of belt 11, preferably parallel to the longitudinal axis thereof as shown, and is arranged to depend below lower belt edge 15 a short distance. First short strap 23 is preferably attached to the outside 25 of belt 11, however, it may be attached to inside belt surface 27 for special performances and such is fully contemplated in this invention.

Figure 4:
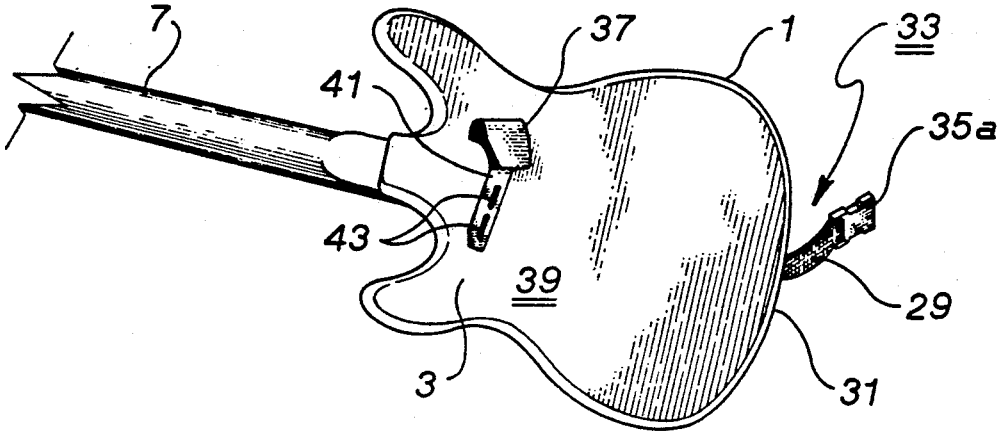
FIG. 4 is a rear view of a generic stringed instrument showing the preferred attachment of the bracket to the instrument.

As shown in FIG. 4, a second short length of flexible strap 29 is attached at one end to instrument 1, preferably at the rear-most portion 31 of sound box 1, otherwise known as the "heel" or "butt" of the instrument. The attachment of second short strap 29 may be made by a wide variety of known means, but preferably, and most commonly, is a simple threaded screw with an accompanying washer (not shown). Straps 23 and 29 should be flexible yet strong enough to support the weight of the instrument. Preferred as material for said straps is tightly woven nylon strap. Other materials, such as polypropylene are also usable.

Means 33 is provided for temporarily interconnecting first short strap 23 and second short strap 29 along their respective lengths to provide for the support, by belt 11, of a portion of the weight of the instrument while at the same time providing room to lift the instrument away from the belt to the various positions shown in phantom outline in FIG. 1. It is preferred that means 33 takes the form of a pair of inter-connectable buckles or clasp elements 35*a* and 35*b*, one of each shown attached to the end of its respective short strap in FIGS. 2*a*, 2*b* and 4. Numerous types of interconnecting elements are already known in the art; they usually comprise male and female inter-connectable elements that have the ability to be attached to straps and adjusted along the length thereof. Also usable in means 33 is a standard cam-type buckle or a pair of unisex buckle elements such as those shown in U.S. Pat. No. 4,171,555.

Figure 3A:
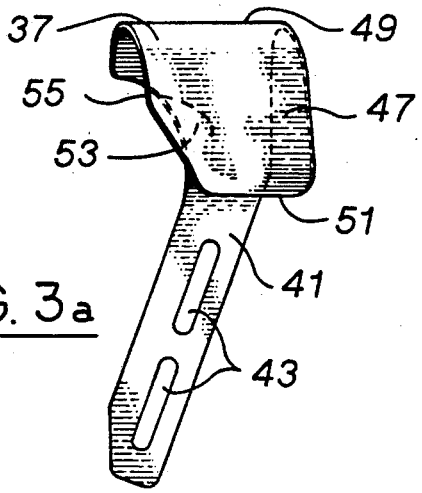
FIGS. 3*a* and 3*b* are respectively the rear and side elevation views of one embodiment of the shaped bracket attached to the stringed instrument.
Figure 3B:
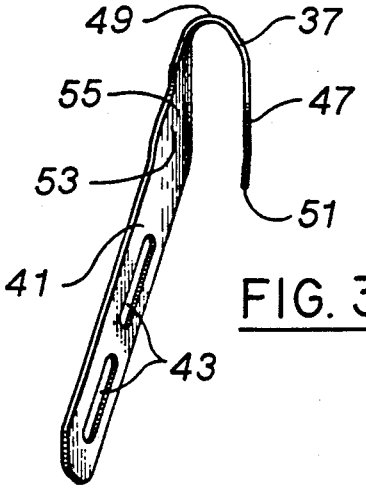
Figure 7:
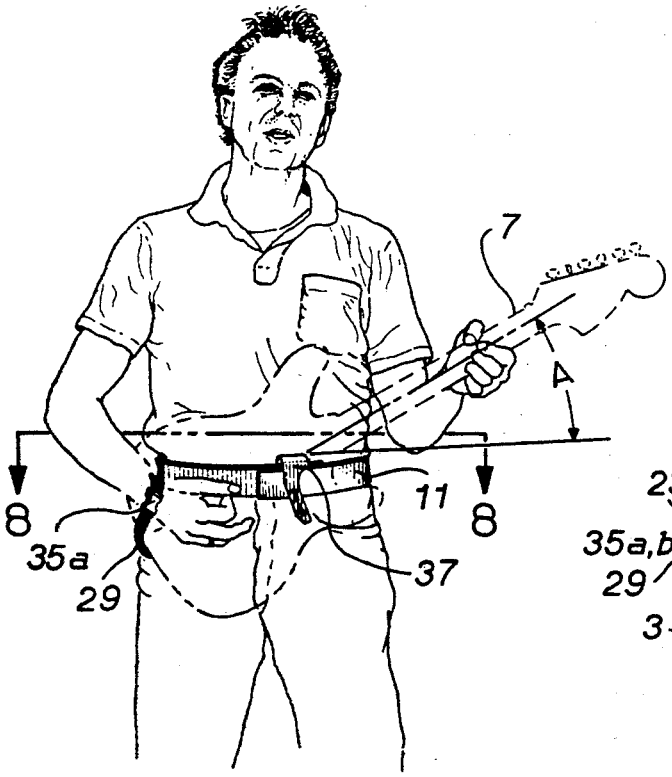
FIG. 7 is an illustrative view of the instrument player showing the generic stringed instrument in playing position in phantom outline and showing how the shaped bracket and other elements of this invention are attached for use by the performer; and, FIG. 8 is a cross-sectional view of the performer taken along lines 8—8 in FIG. 7 showing the position of the waist-encircling belt and how the shaped bracket is utilized to support the instrument in playing position.

As shown in FIGS. 3*a* and 3*b*, a shaped bracket 37 is provided for mounting on instrument 1 to allow the instrument to be temporarily attached to belt 11. Bracket 37 is shown to be mounted to the back surface 39 of sound box 3 spaced-apart from second strap 29 and is shown in FIG. 7 to be used for placing over belt 11 to support the balance of the weight of the stringed instrument in the playing position. The embodiment shown in FIGS. 3*a* and 3*b* shows shaped bracket 37 to comprise an elongated, narrow shank portion 41, preferably containing a pair of spaced-apart elongated slots 43 arranged in end-to-end fashion therealong for receipt therethrough of fastening means such as bolts or screws (not shown) that are either driven into the rear of sound box 3 and driven into that portion of sound box 3 where neck 7, extends thereinto as shown in FIG. 4. Some stringed instruments already employ screws or bolts to join the neck portion to the sound box and, in these cases, such fasteners can be used to mount bracket 37 thereto.

Figure 5B:
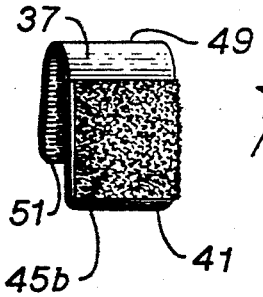
FIGS. 5*a* and 5*b* are rear views of a generic stringed instrument showing another embodiment of attaching the bracket to the instrument.
Figure 5A:
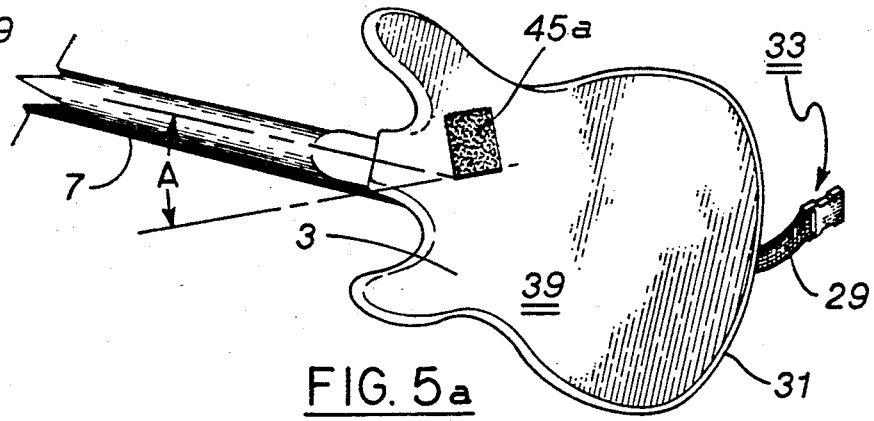

In FIGS. 5*a* and 5*b* are shown an alternative design of bracket 37 and method of attaching it to rear box surface 39. In this embodiment, bracket 37 has a broader shank portion 41. Pads 45*a* and 45*b* of press-together, removeably entangled material like Velcro hook elements and loop elements previously described are attached respectively one to the rear portion of shank portion 41 and the other to rear box surface 39, the latter at angle "A" as shown in FIG. 5*a*, so that they can be pressed together to temporarily mount bracket 37 thereto.

A wide, downwardly angling hook portion 47 is provided in bracket 37 for hooking over the upper belt edge 13 to support the balance of the weight of the musical instrument on belt 11 and aid in holding the musical instrument 1 in the playing position as shown in FIG. 7. Hook portion 47 describes a top edge 49 that forms an acute angle "A" with neck 7 to enable instrument 1 to be held in the playing position, shown in FIG. 7, when hooked over belt top edge 13. Angle "A" is preferably fixed in a range between from about 10° to about 50° and preferably about 25°. As shown in FIG. 5*a*, Velcro pad 45*a* can be attached to rear box surface 39 to provide the same acute angle "A". Hook portion 47 terminates in an outer lip 51. It is further preferred that hook-portion 47 and its top edge 49 be made substantially wide to provide greater stability of the musical instrument in its playing position when hooked over belt 11.

As can be seen in FIGS. 3*a*, 3*b* and 5*b*, bracket 37 contains a transition portion 53 interconnecting shank portion 41 with hook portion 47 and includes a curved or twisted portion 55 providing for hook-portion 47 to be curved away from shank portion 41 to enable hook-portion 47 to retain stringed instrument 1 close against the performer's body as shown in FIG. 8.

Figure 6A:
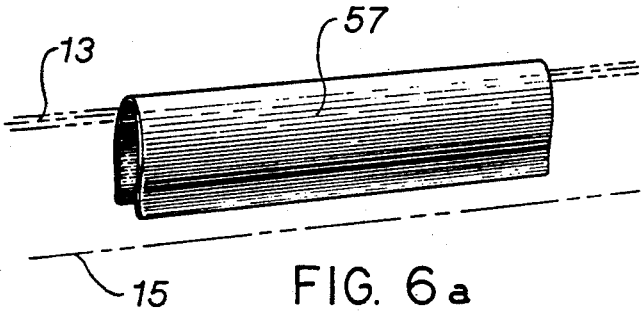
FIGS. 6*a* and 6*b* are respectively the front elevation view and side elevation view of the stiff brace that is usable with the belt shown in FIGS. 2*a* and 2*b;*
Figure 6B:
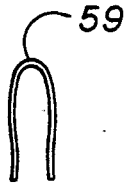

Depending upon the weight of musical instrument 1 and the activity of the performer in removing instrument 1 from its playing position and support on belt 11, and repositioning the same throughout an evening's performance, upper belt edge 13 may become subjected to extensive wear and begin to buckle, fold or otherwise become deformed. To reduce this possibility, a stiff brace 57 is provided, as shown in FIGS. 6*a* and 6*b*, in the form of a wide piece of stiff material folded into a hook portion 59 as shown, that may be hooked over upper belt edge 13 for later receipt there over of hook-portion 47 of shaped bracket 37. Brace 57 may be moved along belt 11 to any position desired by the entertainer in preparation of receiving thereover hook portion 47 of bracket 37. Brace 57 is preferably made wider than bracket hook-portion 47 to provide for some adjustment of bracket 37 without making contact with belt 11. The thickness of brace hook-portion 59 should be made narrower than bracket hook-portion 47 to enable hook-portion 47 to easily slip over brace 57 during use.

Belt 11 is preferably made from pliant materials such as leather, leather substitutes and plastics. Straps 23 and 29 are preferably made from flexible, pliant materials such as woven nylon cloth or other similar materials. Shaped bracket 37 may be conveniently made from stiff plastic or from lightweight metal such as aluminum or titanium. Stiff brace 57 may be made from a wide variety of stiff materials but preferably from plastic such as polyvinylchloride and the like, or metals such as brass, aluminum, etc.

What is claimed is:

1. A device for removably supporting a stringed instrument in playing position of the type comprising a large sound box with strings mounted thereover that extend along a narrow neck, comprising:

a) a wide, waist-encircling belt defined by spaced-apart upper and lower edges, terminated by spaced-apart ends and including means for attaching said belt about one's waist in overlap fashion;

b) a first short length of flexible strap attached at one end to said belt;

c) a second short length of flexible strap attached at one end to said instrument, spaced-apart from said neck;

d) means for temporarily interconnecting said first and said second straps to provide support for a portion of the weight of the instrument while providing room to lift the instrument away from said belt; and, e) a shaped bracket including:

i) a shank portion including means for mounting on a back surface of the sound box spaced-apart from said point of attachment of said second strap;

ii) a wide, downwardly angling hook portion, forming a top edge that is fixed at an acute angle with the neck of the instrument, for hooking over said belt to temporarily support the balance of the weight of the stringed instrument and retain it in playing position; and, iii) a transition portion interconnecting said shank portion and said hook portion, curving away from said base portion to enable said hook portion to retain the stringed instrument close against the performer's body.

2. The device for removably supporting a stringed instrument in playing position of claim 1 wherein said means for attaching said belt about one's waist in overlap fashion includes a pad of deformable hook elements attached to one surface of said belt near one of said ends and a pad of deformable loop elements attached to the other surface of said belt near the other of said ends for removably entangling said elements by pressing said pads together.

3. The device for removably supporting a stringed instrument in playing position of claim 2 wherein said pads are constructed of "Velcro" material.

4. The device for removably supporting a stringed instrument in playing position of claim 1 further including a stiff brace for temporarily mounting along the upper edge of said belt arranged to receive thereover said hook portion of said bracket to protect said belt from deforming under the weight of the instrument.

5. The device for removably supporting a stringed instrument in playing position of claim 4 wherein said stiff brace includes a downwardly projecting hook portion for hooking over the upper edge of said belt, said hook portion of a thickness less than said downwardly angling hook portion of said bracket to allow said bracket hook portion to slip over said brace hook portion.

6. The device for removably supporting a stringed instrument in playing position of claim 1 wherein said waist encircling belt is of a length sufficient to allow said ends to be fixed in overlapping engagement.

7. The device for removably supporting a stringed instrument in playing position of claim 1 wherein said first strap is adapted to be mounted to a front surface of said belt.

8. The device for removably supporting a stringed instrument in playing position of claim 1 wherein said second strap is attached to the back side of the sound box adjacent a terminal end of the instrument opposite from the neck thereof.

9. The device for removably supporting a stringed instrument in playing position of claim 1 wherein said means for temporarily interconnecting said first and said second straps includes a pair of inter-connectable buckle elements, one element carried by each of said first and said second straps.

10. The device for removably supporting a stringed instrument in playing position of claim 9 wherein at least one of said interconnectable buckle elements includes means for adjusting its position along said strap.

11. The device for removably supporting a stringed instrument in playing position Of claim 1 wherein said means for temporarily interconnecting said first and said second straps includes a cam buckle.

12. The device for removably supporting a stringed instrument in playing position of claim 1 wherein said means for mounting said shank portion of said bracket includes at least one elongated aperture formed is said shank portion, for receipt therethrough of attachment means for connection to the back of the sound box near a point where the neck extends therefrom.

13. The device for removably supporting a stringed instrument in playing position of claim 9 wherein said shank portion of said bracket has formed therein two elongated apertures and said attachment means include a threaded member.

14. The device for removably supporting a stringed instrument in playing position of claim 1 wherein said means for mounting said shank portion of said bracket includes a pad of deformable, hook elements affixed to the back of said shank portion and a pad of deformable loop elements affixed to the back of said sound box for removably entangling said elements by pressing said pads together.

15. The device for removably supporting a stringed instrument in playing position of claim 14 wherein said pads are constructed of "Velcro" material.

16. The device for removably supporting a stringed instrument in playing position of claim 11 wherein said hook portion of said bracket makes an angle with the neck of the instrument of from about 10° and about 50°.

17. The device for removably supporting a stringed instrument in playing position of claim 16 wherein said hook portion of said bracket makes an angle with the neck of the instrument of 25°.

18. The device for removably supporting a stringed instrument in playing position of claim 1 wherein said downwardly projecting hook portion of said shaped bracket is substantially wider than said shank portion thereof.

19. The device for removably supporting a stringed instrument in playing position of claim 1 wherein said wide, downwardly projecting hook portion of said shaped bracket is terminated by an outer lip.

* * * * *